US005566843A

United States Patent [19]

Kruska

[11] Patent Number: 5,566,843

[45] Date of Patent: Oct. 22, 1996

[54] RETRACTABLE FOLDING HANGER DEVICE

[76] Inventor: Phillip C. Kruska, 3031 W. Charter Oak, Phoenix, Ariz. 85029

[21] Appl. No.: 204,586

[22] Filed: Mar. 1, 1994

[51] Int. Cl.[6] ..... A47H 1/00

[52] U.S. Cl. ..... 211/104; 211/1.3; 211/99

[58] Field of Search ..... 211/104, 1.3, 99, 211/100; 248/308, 284.1, 305

[56] References Cited

U.S. PATENT DOCUMENTS

| | | | |
|---|---|---|---|
| 1,318,257 | 10/1919 | Blaustein | 211/99 |
| 1,605,510 | 11/1926 | Carskadon . | |
| 2,471,349 | 5/1949 | Reiss | 211/99 |
| 2,484,535 | 10/1949 | Stader | 211/99 |
| 2,706,049 | 4/1955 | Andrews | 211/104 X |
| 3,941,250 | 3/1976 | Ott | 211/100 X |
| 4,171,748 | 10/1979 | Fabian | 211/1.3 |
| 4,535,896 | 8/1985 | Evenson | 211/43 |
| 4,632,255 | 12/1986 | Kennedy | 211/1.3 |

*Primary Examiner*—Karen J. Chotkowski
*Assistant Examiner*—Anita M. King
*Attorney, Agent, or Firm*—Richard R. Mybeck; Peter B. Scull

[57] ABSTRACT

A retractable folding hanger device for attachment to a flat surface having a base member, an extension arm pivotally attached at the first end thereof to the base member, and a retention arm pivotally attached to the second end of the extension arm. Each of the frame members is preferably channel-shaped and dimensioned so that the retention arm is foldable into and nestable within the extension arm and the nested extension arm and retention arm are likewise foldable into and nestable within the base member. Suitable hinge pins provide the pivotal attachments to the device and solid-body or spring-biased stops hold the device in its open or deployed position. A magnet or a clasp is provided to secure the device in its closed or retracted position.

12 Claims, 3 Drawing Sheets

RETRACTABLE FOLDING HANGER DEVICE

INTRODUCTION

This invention relates generally to retractable folding hanger devices, and more particularly to a novel and unique retractable folding hanger device for installation primarily on flat vertical surfaces to support a variety of objects therefrom. The device is especially useful when mounted to a recreational vehicle (RV) to provide a convenient, accessible, and non-obtrusive means for hanging much of the equipment associated therewith.

BACKGROUND OF THE INVENTION

The present invention relates to a retractable folding hanger device which attaches to a substantially flat surface, either vertically or horizontally, and which, when not in use is capable of being folded into a retracted state to occupy a much reduced and non-obtrusive space. The device is easily unfolded to provide means for supporting coils of hose or cable, as an example, or folding chairs, lanterns, clothing or other objects which have means associated therewith of a size appropriate to suspend such items from the extension and retention arms of the present invention.

Some prior art efforts to provide a multi-purpose hanging device were non-foldable fixed structures which were not retractable into compact entities when not in use such as the device described in Eads et al. in U.S. Pat. No. 4,436,267.

Others lacked compactness and efficient space utilization, or like many devices such as that described by LaBeaud in U.S. Pat. No. 3,920,127, early efforts lacked retention means and therefore allowed objects or coils stored thereon to fall off. Still further prior art devices include Lindquist which, in U.S. Pat. No. 1,716,923 discloses a device for suspending clothes hangers having two arm members, namely, a first horizontal extension arm for hanging hangers therefrom attached at one end to a vertical surface, and a second diagonal support arm attached to the vertical surface above the extension arm and attached to the other end of the extension arm. The use of devices such as Lindquist for hanging coiled objects, such as hoses or cables, is limited because such objects must be threaded through the device for hanging or removal and a plurality of coils cannot be hung therefrom without laboriously reeving therethrough.

Other prior patents describe devices that are designed to support generally flat objects by means of diagonal supports propped beneath a horizontal extension member as described, for example, by Bergkamp et al. in U.S. Pat. No. 3,730,107. Bergkamp also appears to be ill-disposed to hang objects therefrom because of the presence of the diagonal support member. As above, the storage of elongated or coiled objects would require laborious threading through the device and would have limited free hanging space beneath the horizontal extension member. Still other prior art examples of horizontal support structures with diagonal braces or support members which would impair the storage of elongated objects therefrom include Carskadon (U.S. Pat. No. 1,605,510), Howe (U.S. Pat. No. 1,937,386), Swanson (U.S. Pat. Nos. 2,031,287 and 2,038,143), and Bell (U.S. Pat. No. 2,577,399). It should be noted that while Carskadon, supra, discloses foldable members which are pivotable into substantially upright positions, these members cannot function as retention arms to hold objects hung from the horizontal support because the slightest lateral force applied to these upright members will cause them to collapse into non-supporting positions.

Another prior art retractable hanger device is described in Antoszewski (U.S. Pat. No. 4,101,107). Antoszewski discloses a device having permanently-shaped, curved fingers integrally attached to a horizontal cross member that is offset by a pair of vertical legs. This integral device is pivotally attached to a narrow vertical member such as a wooden stud and is retractable by pivoting the whole device upward until the device straddles the narrow vertical member and the fingers lie against or are stowed adjacent the sides of the narrow vertical member. Though Antoszewski appears to propose a retractable folding device for hanging objects therefrom, it does not suggest the retraction of the various frame members into one compact, nested unit and is not adaptable to any flat mounting surface.

Accordingly, a need still exists for the creation of a retractable folding hanger device for installation on flat surfaces which, when not in use, can be placed in a non-obtrusive retracted state. It is toward this need that the present invention is directed.

SUMMARY OF THE INVENTION

The present invention is a retractable folding hanger device that provides support for tools, equipment, material, or clothing hung on a wall or from a ceiling and that folds within itself when not in use to conserve space, to facilitate other uses of the storage area, to render the space less hazardous to those working in the area, and to be more visually attractive. This hanger device is made from at least three sturdy frame members pivotally hinged together such that all the members may be folded into and be completely nested within the largest member. This device further includes means for holding or securing itself in open or deployed position and for securing it in closed or retracted position.

Accordingly, the primary object of the present invention is to retainably support objects hung on a simple, sturdy hanger device that retractably folds into a compact unit when not in use and which is adaptable to any flat mounting surface.

Another object of the present invention is to provide a retractable retention means for a retractable folding hanger device that will retain a plurality of objects hung upon the device.

Still another object of the present invention is to hold or lock a retractable folding hanger device including a retention means in either an open or closed position without obstruction of objects hung thereon by diagonal or other support members.

These and still further objects, as shall hereinafter appear, are readily fulfilled by the present invention in a remarkably unexpected manner as will be readily discerned from the following detailed description of an exemplary embodiment thereof especially when read in conjunction with the accompanying drawings in which like numbers bear like indicia throughout the several views.

PREFERRED EMBODIMENT

Figure 1:
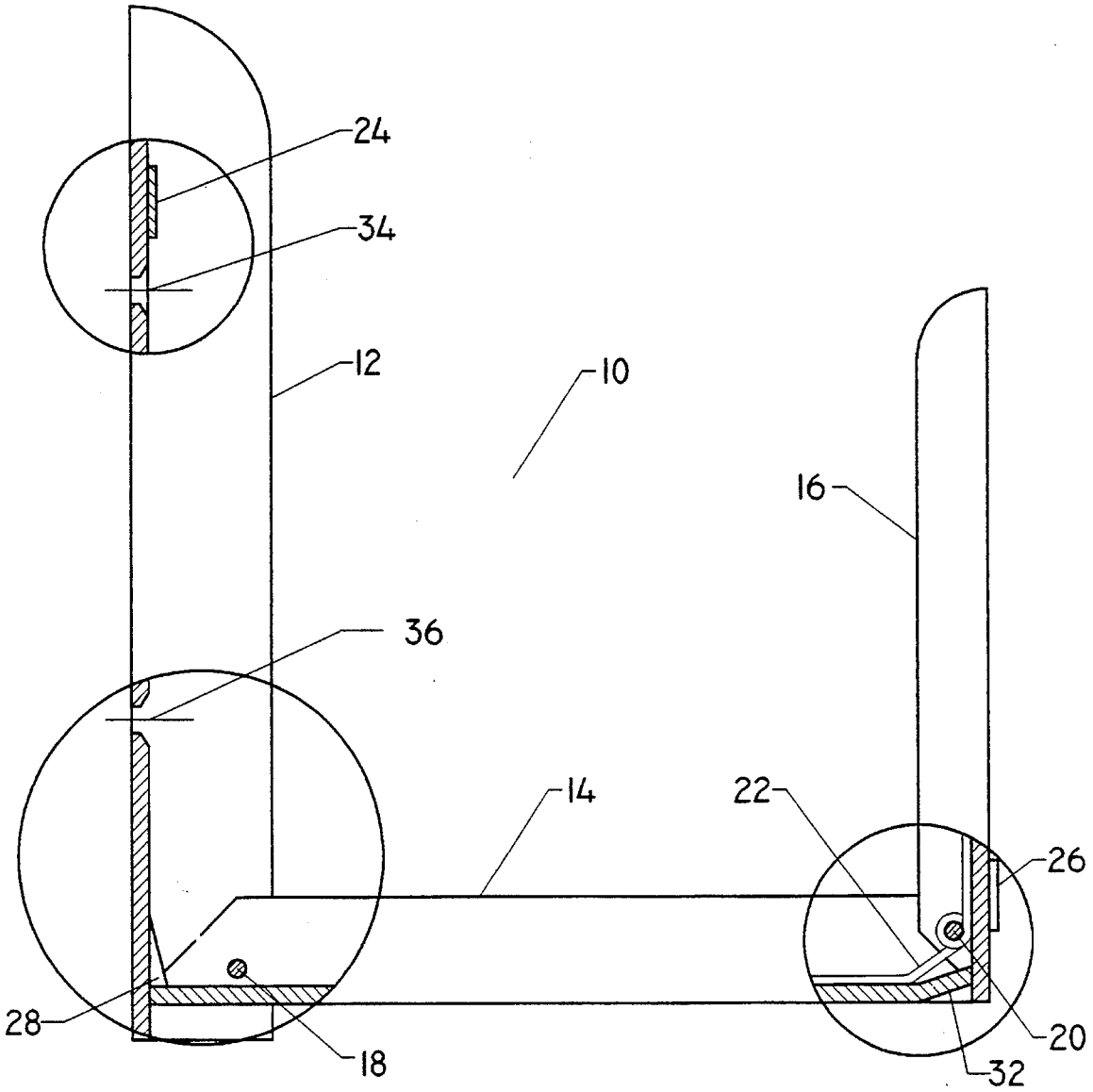
FIG. 1 is a side elevation, partially in section, of a retractable folding hanger device embodying the present invention in its open position.

The present invention relates to a retractable folding hanger device identified in the drawings by the general reference 10 having a base means for attaching device 10 to a mounting surface, an extension means for hanging objects therefrom, and a retention means for retaining objects hung on device 10.

As shown in FIG. 1 device 10 comprises at least three frame members designated here as base member 12 which embodies the base means of the preferred embodiment, extension arm 14 and retaining arm 16 likewise embodying the extension means and retention means respectively, of the preferred embodiment. Also shown are hinge pins 18, 20, spring 22, and magnets 24, 26. Both FIGS. 1 and 3 have sectional views showing mounting holes 34, 36, hinge pins 18, 20, and integrally attached stops 28, 30, and 32 which hold extension arm 14 and retaining arm 16 in open, deployed position. These sectional views also show spring 22 which holds retaining arm 16 in upright, open position, and magnet pair 24, 26 which holds device 10 closed when retractably folded.

Figure 2:
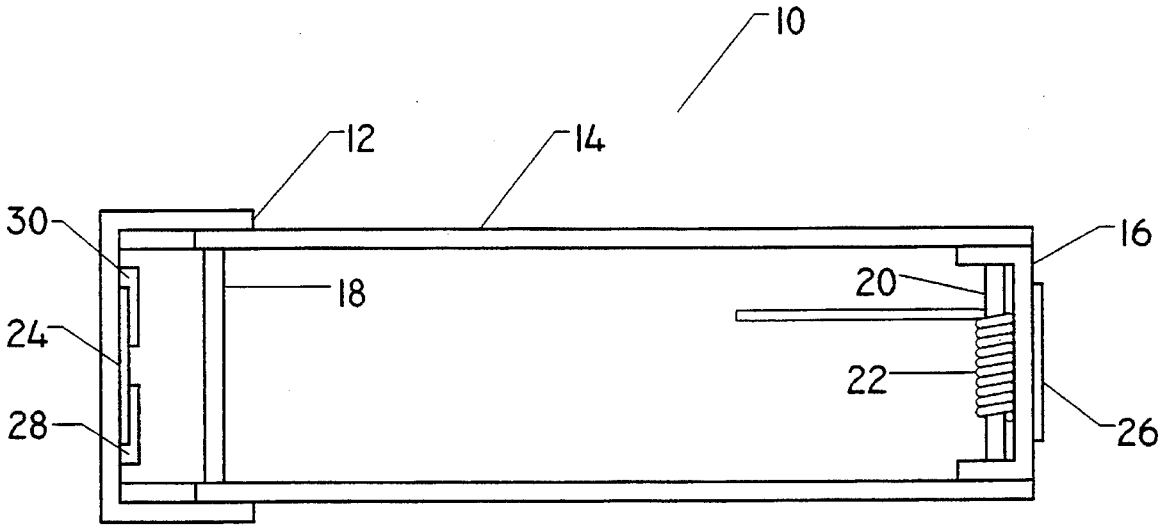
FIG. 2 is a plan view of the device of FIG. 1.
Figure 3:
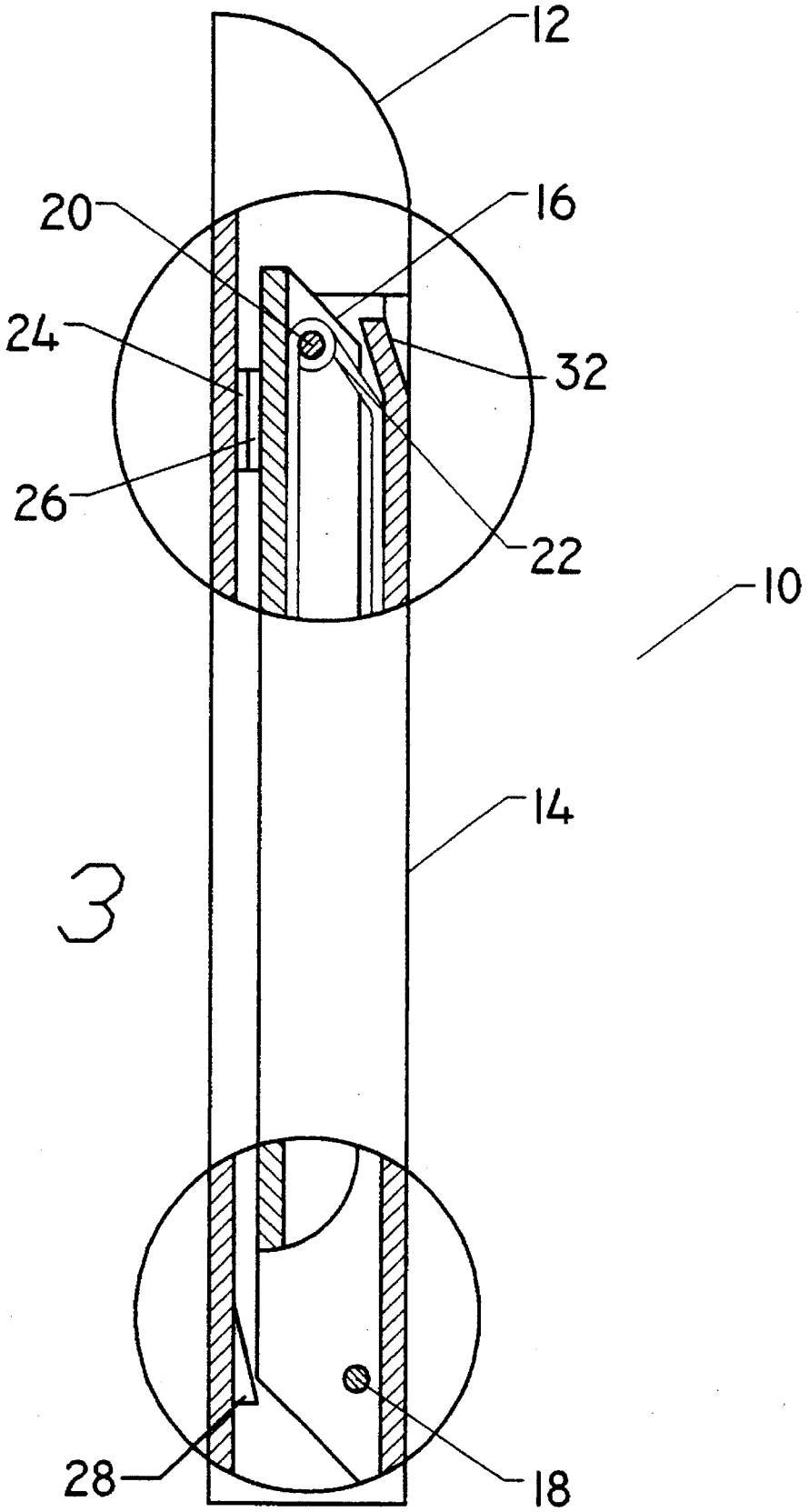
FIG. 3 is a side elevation, partially in section, of the device of FIG. 1 in its closed position.

As shown in FIGS. 2 and 3, frame members 12, 14, and 16 are U-shaped channels which are progressively smaller in width such that retaining arm 16 fits within the side walls of extension arm 14, which in turn fits within the side walls of base member 12. A means for pivotally connecting frame members 12, 14, and 16 at the ends thereof to alternately open and close (or deploy and retract) device 10 preferably includes hinge pins 18, 20. Extension arm 14 is pivotable about hinge pin 18 which is inserted through the side walls of both base member 12 and extension arm 14, and is frictionally fixed to base member 12 as described further below. Retaining arm 16 is pivotable about hinge pin 20 which is inserted through the side walls of both extension arm 14 and retaining arm 16, and is similarly frictionally fixed to extension arm 14.

A means for holding device Z0 in open or (or deployed) position as shown in FIGS. 1 and 2, so that equipment may be stored thereon preferably includes spring 22 and stops 28, 30, and 32. The pivotal travel of extension arm 14 about hinge pin 18 is limited by stops 28, 30 which are integrally attached to base member 12. Pivotal travel of retaining arm 16 about hinge pin 20 is limited by stop 32 which is integrally attached to extension arm 14. Spring 22, which is disposed on hinge pin 20 and connected between extension arm 14 and retaining arm 16, forces retaining arm 16 to rotate about hinge pin 20 to the open position against stop 32 when device 10 is unfolded. When retaining arm 16 is manually pivoted to fold into or nest within extension arm 14, spring 22 is compressed between arms 14 and 16.

Pivoting nested arms 14 and 16 into the space between the side walls of base member 12 brings magnets 24 and 26 into contact with each other to hold arms 14 and 16 in nested closed position within base member 12 without other external restraints. Thus, magnets 24, 26 are the means for holding device 10 in closed or retracted position for storing device.

Countersunk mounting holes 34 and 36 are provided to preferably allow the use of flat head screws to secure device 10 to a flat mounting surface without the screws physically touching or interfering with the nesting of extension arm 14 and retaining arm 16 within base member 12 when device 10 is put in the retracted state.

Device 10 of the present invention may be made from any of a plurality of commercially available materials including lightweight metals such as aluminum, or sturdy plastics such as styrene. As described, frame members 12, 14, and 16 are preferably U-shaped having transverse dimensions to enable retaining arm 16 to fit or nest completely within extension arm 14 and so that this nested union of extension arm 14 and retention arm 16 likewise fits or nests completely within base member 12. Further, hinge pins 18 and 20 are preferably metal dowels but may also be made of a variety of materials so long as they fixedly attach to one frame member while allowing smooth rotation or pivotal motion of the adjacent arm member also connected thereto. Similarly, many alternative materials may be used for spring 22 and solid-body stops 28, 30, and 32 so long as they coact to securely hold device 10 in the deployed position shown in FIG. 1.

To assemble device 10, frame members 12, 14, and 16 are first cut from channel stock of predetermined dimensions such that each of the three members may be completely nested within each successive member as described above. Alternatively, these members may be molded, pre-cast or otherwise formed. Also, circular or elliptical cross-sectional stock may be substituted for channel stock, or solid frame members or a combination of solid and channel-type stock may be used so long as device 10 is retractably foldable substantially as described herein. Of course, if solid members are used, these will be foldable so that they will lie in juxtaposition to, or side by side each other when retracted, and not nested within each other nor nested within the base member.

Stops 28, 30, and 32 are integrally attached with adhesive or by other suitable fastening means to base member 12 and extension arm 14, or may be integrally shaped from the frame members themselves by either cutting and bending portions of frame members 12 and 14 or they may be molded as integrally attached to frame members 12 and 14 if members 12 and 14 are pre-cast.

Holes for hinge pins 18 and 20 of predetermined dimensions are formed in the side walls of frame members 12, 14, and 16 such that when properly aligned, hinge pins 18 and 20 may be pressed into place to pivotally connect frame members 12, 14, and 16 as described above. These holes may be either drilled, molded or otherwise formed depending on the shapes and materials used. Hinge pin 18 is press fit into its corresponding holes in base member 12 and extension arm 14 which are sized such that hinge pin 18 is frictionally fixed or secured to base member 12 while allowing free pivotal motion of extension arm 14 thereabout. Similarly, hinge pin 20 is press fit into its corresponding holes in extension arm 14 and retention arm 16 which are also sized so that hinge pin 20 is frictionally secured in extension arm 14 while retaining arm 16 remains freely pivotal thereabout.

Countersunk mounting holes 34, 36 are likewise formed in base member 12, and are sized such that suitable fastening means such as flat head screws, nails and the like, may be employed to hold device 10 securely in its mounted position, even when fully loaded by objects hung therefrom. Alternatively, the base means of device 10 may be attached to a mounting surface either permanently, by welding or by using an adhesive, or detachably through use of a notched or tapered mating receptacle (not shown) which itself is attached to the mounting surface. A notch in or a protruding taper on base member 12 mates with a corresponding protrusion or notch in the mating receptacle. The use of mating receptacles enables interchangeability of devices 10 such that different sizes, shapes and strengths may be interchangeably attached to the same mounting receptacle.

Spring 22 is preferably a coiled wire spring as shown in FIGS. 1 and 2. During assembly, spring 22 is properly aligned such that hinge pin 20 is inserted therethrough when pressed into the holes in arm members 14 and 16. Nevertheless, spring 22 may, in the alternative, be a flat leaf spring or a piano hinge so long as it is properly disposed to hold retaining arm 16 in upright, open position when device 10 is deployed for use. Further, spring 22 may be replaced by a manual release catch that engages when retaining arm 16 is fully deployed, or may be integrally formed as part of an arm member such as in the formation of a polypropylene hinge as part of a polypropylene arm member.

Magnet pair 24 and 26 are attached to base member 12 and retaining arm 16 at corresponding locations as shown in FIGS. 1 and 3 and are used to hold device 10 securely closed. Alternatively, the means for holding device 10 in locked closed position may include a pivotal clasp pin attached to one of the frame members such as base member 12 to clasp one or the other frame members, or a spring clamp, notch and pawl, or equivalent restraint.

In use, the base means of device 10 is first attached to a substantially flat mounting surface (not shown) by any appropriate fastening means as described above. From its closed position, device 10 is opened by disengaging the closure means, such as magnet pair 24, 26 as shown, and manually rotating or pivoting extension arm 14 (which has retaining arm 16 folded or nested therein) down from the closed position shown in FIG. 3 to the open position shown in FIG. 1 so that it is perpendicular to or extended orthogonally from base member 12. Further downward rotation is halted by stops 28, 30, Then, retaining arm 16 is folded upward and outward from its nested position within extension arm 14 to the open or deployed position shown in FIG. 1. In particular, retaining arm 16 is extended perpendicular to or orthogonally from extension arm 14 to a generally upright and parallel position relative to base member 12. The means for holding device 10 in open position includes spring 22 and stops 28, 31, and 32. Spring 22 forces retaining arm 16 to remain in this upright, open position and stops 28, 30, and 32 hold device 10 in this open or deployed generally U-shaped position by not allowing the force of gravity or other forces to pivot extension arm 14 any further downward or retaining arm 16 any further outward.

Device 10 is then ready for storage of equipment, coils of hose or cable or other objects suitable for hanging therefrom. Such objects are hung on the extension means shown in the preferred embodiment as extension arm 14. Retaining arm 16 provides the retention means for holding these objects on the extension means. An alternative embodiment of device 10 includes a fourth frame member (not shown) which is nestable within retaining arm 16 and extendable therefrom to provide retention means for a device 10 mountable on a horizontal surface such as a ceiling.

Device 10 is closed or retracted by following the reverse process. First, any objects hung on device 10 are removed. Then retaining arm 16 is folded down into or nested within extension arm 14 which is then folded up into a nested relationship within base member 12. Magnets 24, 26 meet (or other appropriate fastening means are engaged) to hold device 10 securely in its closed or retracted position as shown in FIG. 3 so that it is out of the way when not in use.

From the foregoing, it is readily apparent that a new and useful embodiment of the present invention has been herein described and illustrated which fulfills all of the aforestated objects in a remarkably unexpected fashion. It is, of course, understood that such modifications, alterations and adaptations as may readily occur to the artisan confronted with this disclosure are intended within the spirit of this disclosure which is limited only by the scope of the claims appended hereto.

Accordingly, what is claimed is:

1. A retractable folding hanger device comprising:

base means for attaching said device to a flat surface;

extension means for hanging objects therefrom;

retention means for retaining objects hung on said extension means;

first connection means for pivotally connecting said extension means to said base means; second connection means for pivotally connecting said retention means to said extension means;

holding means for unobstructedly holding said device in an open position whereupon said extension means extends substantially orthogonally from said base means and said retention means extends substantially orthogonally from said extension means;

said base means, said extension means and said retention means each defining a U-shaped channel, each said channel having a transverse dimension to enable said retention means to nest within said extension means, and said extension means to nest within said base means so that when said device is in its retracted position, said retention means and said extension means fold into a nested relationship within said base means.

2. A hanger device according to claim 1 which further comprises means for holding said device in a retracted position when said device is not in use.

3. A hanger device according to claim 1 in which:

said first connection means for pivotally connecting said extension means to said base means and said second connection means for pivotally connecting said extension means to said retention means comprise hinge pins.

4. A hanger device according to claim 1 in which:

said means for holding said device in open position comprises first solid-body stops integrally attached to said base means and second solid-body stops integrally attached to said extension means.

5. A hanger device according to claim 1 in which:

said means for holding said device in open position comprises a spring connected between said extension means and said retention means.

6. A hanger device according to claim 2 in which:

said means for holding said device in retracted position comprises magnets attached to said base means and said retention means.

7. A retractable folding hanger device comprising:

a base member, an extension arm having a first end and a second end, and a retaining arm;

first connection means for pivotally connecting said first end of said extension arm to said base member and second connection means for pivotally connecting said second end of said extension arm to said retaining arm;

holding means for unobstructedly holding said device in an open position whereupon said extension arm extends substantially perpendicular to said base member and said retaining arm extends substantially perpendicular to said extension arm in generally parallel relationship to said base member; and said base member said extension arm and said retaining arm each defining a U-shaped channel, each said channel having a transverse dimension that enables said retaining arm to nest within said extension arm, and said extension arm to nest within said base member so that when said device is in its retracted position said retaining arm and said extension arm fold into a nest relationship within said base member.

8. A hanger device according to claim 7 which further comprises means for holding said device in a retracted position when said device is not in use.

9. A hanger device according to claim 7 in which:

said first connection means for pivotally connecting said first end of said extension arm to said base member and said second connection means for pivotally connecting said second end of said extension arm to said retaining arm comprise hinge pins.

10. A hanger device according to claim 7 in which:

said means for holding said device in open position comprises first solid-body stops integrally attached to said base member and second solid-body stops integrally attached to said extension arm.

11. A hanger device according to claim 7 in which:

said means for holding said device in open position comprises a spring connected between said extension arm and retaining arm.

12. A hanger device according to claim 8 in which:

said means for holding said device in retracted position comprises magnets attached to said base member and said retaining arm.

* * * * *